United States Patent [19]

Friebe et al.

[11] Patent Number: 4,642,030

[45] Date of Patent: Feb. 10, 1987

[54] ARRANGEMENT FOR FEEDING FUEL FROM SUPPLY TANK

[75] Inventors: Karl-Heinz Friebe, Schwieberdingen; Karl-Otto Heinz, Waiblingen; Werner Scholten, Stuttgart, all of Fed. Rep. of Germany

[73] Assignee: Robert Bosch GmbH, Stuttgart, Fed. Rep. of Germany

[21] Appl. No.: 801,613

[22] Filed: Nov. 25, 1985

[30] Foreign Application Priority Data

Jan. 4, 1985 [DE] Fed. Rep. of Germany ..... 3500139

[51] Int. Cl.[4] ..... F04C 2/10

[52] U.S. Cl. ..... 417/203; 417/366

[58] Field of Search ..... 417/201, 203, 205, 366, 417/368; 418/171, 166

[56] References Cited

U.S. PATENT DOCUMENTS

| | | | |
|---|---|---|---|
| 1,927,799 | 9/1933 | Mann | 417/203 |
| 2,055,587 | 9/1936 | Pigott | 417/203 |
| 2,134,686 | 11/1938 | De Lancey | 417/201 |
| 2,153,360 | 4/1939 | Auger et al. | 417/201 |
| 3,011,447 | 12/1961 | Brundge | 417/203 |
| 3,676,025 | 7/1972 | Shultz et al. | 415/119 X |
| 4,336,002 | 6/1982 | Rose | 417/203 |
| 4,540,354 | 9/1985 | Tucker | 418/171 X |
| 4,566,866 | 1/1986 | Kemmner | 417/366 |

*Primary Examiner*—Richard E. Gluck
*Attorney, Agent, or Firm*—Michael J. Striker

[57] ABSTRACT

An arrangement for feeding a fuel from a supply tank to an internal combustion engine, the arrangement comprises a motor; a multistage feed pump unit driven by the motor and including a flow pump having a rotor and a gerotor pump having an inner runner arranged so that the rotor and the inner runner have aligning axes of rotation and the flow pump is arranged upstream of the rotor pump as considered in the flow direction of a fuel, the rotor of the flow pump and the inner runner of the gerotor pump being located near one another as considered in an axial direction, the gerotor pump also having an outer runner which surrounds a feed chamber, and the rotor of the flow pump having a wall which axially limits the feed chamber surrounded by the outer runner of the gerotor pump.

12 Claims, 6 Drawing Figures

ARRANGEMENT FOR FEEDING FUEL FROM SUPPLY TANK

BACKGROUND OF THE INVENTION

The present invention relates to an arrangement for feeding fuel from a supply tank to an internal combustion engine.

Arrangements of the abovementioned general type are known in the art. One of such arrangements has a pump chamber of a gerotor pump, which is limited by two special end walls. In another multistage pump arrangement the rotors of each pump stage are arranged in a single chamber and separated by a wall which is fixed to a frame. Such an arrangement requires relatively high manufacturing and mounting expenses and at the same time it is of big size.

SUMMARY OF THE INVENTION

Accordingly, it is an object of the present invention to provide an arrangement for feeding a fuel from a supply tank to an internal combustion engine, which avoids the disadvantages of the prior art.

More particularly, it is an object of the present invention to provide an arrangement for feeding a fuel from a supply tank to an internal combustion engine, which has the advantage in that an intermediate wall between both pump chambers can be dispensed with, so that the arrangement has low manufacturing and mounting cost and at the same time has a shorter length.

In keeping with these objects and with others which will become apparent hereinafter, one feature of the present invention resides, briefly stated, in an arrangement for feeding a fuel from a supply tank to an internal combustion engine in which the rotor of the flow pump and the inner runner of the gerotor pump are arranged near one another in direction of the axis of rotation, and a wall of the rotor of the flow pump limits a feed chamber in an axial direction at its one side, while the feed chamber is surrounded by the outer runner of the gerotor pump.

When the arrangement is designed in accordance with the present invention it attains the abovementioned objects.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
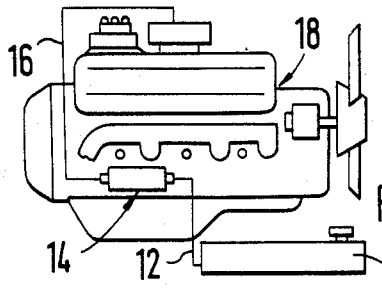
FIG. 1 is a view showing a fuel supply tank, an arrangement for feeding a fuel in accordance with the present invention, and an internal combustion engine.

As can be seen from FIG. 1, the fuel supply tank is connected via a suction conduit with a suction side of an arrangement for feeding fuel identified with reference numeral 14. A pressure conduit 16 is connected with a pressure side of the arrangement for feeding fuel and leads to an internal combustion engine 18. During the operation of the internal combustion engine the arrangement for feeding fuel 14 feeds the fuel from the supply tank 10 to the internal combustion engine 18.

Figure 2:
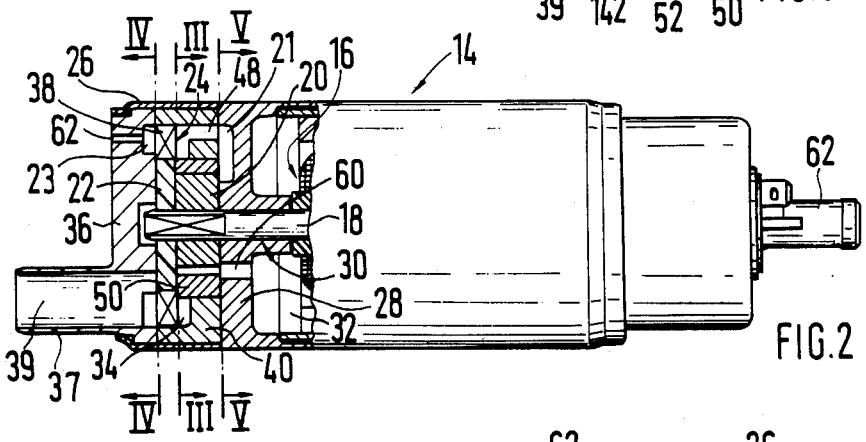
FIG. 2 is a view showing the arrangement for feeding a fuel in accordance with the present invention on an enlarged scale and partially sectioned in a longitudinal direction.

The arrangement for feeding a fuel in accordance with the present invention is shown in FIG. 2. It has an electric drive motor 16 with a driven or armature shaft 18. The shaft 18 is connected with rotors 20 and 22 of a two-stage feed pump 24. The drive motor 16 and the feed pump 24 are surrounded by a tubular and cup-shaped housing 26.

The housing 26 is subdivided by an intermediate wall 28 which is fixed to the housing. The armature shaft 18 extends through the intermediate wall and is supported in it in a bearing location 30. The housing 26 encloses a first chamber 32 in which the abovementioned electric drive motor 16 is located. Furthermore, a second chamber 34 is formed in the housing 26 and serves as a pump chamber 21 and 23 for both pump stages. The rotors 20 and 22 are accommodated in the pump chamber 21 and 23.

The housing 26 is closed at the pump side by a cover 36 which has a supply pipe 37 for the feed pump 24. The front pump stage 23, as seen from the supply or suction pipe 37, is formed as a flow pump which in the embodiment of FIG. 2 is formed as a so-called open, lateral channel pump. The construction and the operation of such a pump is disclosed, for example in the U.S. Pat. No. 3,676,025 or in the U.S. Pat. No. 3,947,149 and therefore are not described here in detail. The rotor 22 of the lateral channel pump 24 is provided on its periphery with vanes or feeding member 38.

Approximately ring-shaped lateral channels 42 and 44 are provided in the cover 36 and in an outer guide ring 40 which belongs to the second pump stage 21. The lateral channels 42 and 44 are associated with the vanes or feed members 38. The diameter of the channel curvature is determined upon the diameter of the circle of rotation of the feed members 38. A suction opening 39 formed in the suction pipe 37 opens into the lateral channel 42 (FIG. 4) which is arranged in the cover 36. The lateral channel 44 is mirror-symmetrical to the lateral channel 42 in the cover and is located in the guiding ring 40 particularly in its end side facing toward the rotor 22 of the first pump stage 23.

Figure 4:
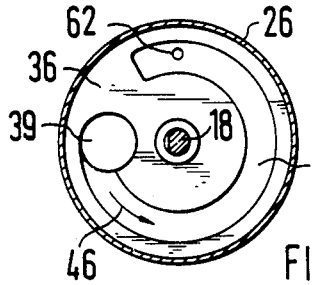
FIG. 4 is a view showing a section through the arrangement for feeding a fuel of FIG. 3, taken along the line IV—IV.
Figure 3:
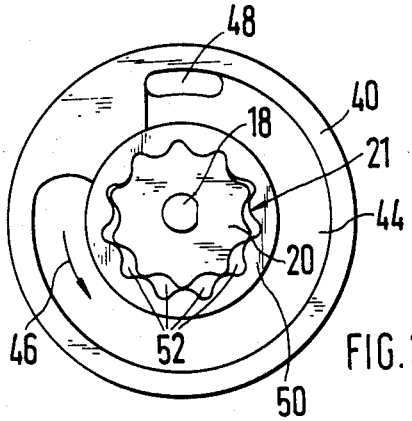
FIG. 3 is a view showing a section of the arrangement for feeding a fuel, taken along the line III—III on an enlarged scale, wherein only the parts of a gerotor pump are shown.

As shown by arrow 46 in FIG. 4, during the operation of the arrangement the medium to be fed flows from the suction opening 39 in counterclockwise direction to the lateral channel 42. This medium flow is then also available in the lateral channel 44 arranged in the guide ring 40. An overflow channel 48 is located at the end of the lateral channel 44 (FIG. 3) as considered in direction of the arrow 46 in the guide ring 40 which forms a stationary element of the pump 24. The supply medium flows through the overflow passage 48 from the pressure side of the lateral channel pump 23 into the suction region of the second pump stage 21.

The second pump step includes the abovementioned rotor 20 which is connected with the driven or armature shaft 18 for joint rotation therewith, and also a further ring-shaped outer rotor 50 which surrounds the inner rotor 20. The outer rotor 50 is surrounded by the guide ring 40 and is guided by the latter. As can be seen particularly from FIG. 3, the second pump step 21 is formed as a so-called gerotor pump. Its construction and operation is described, for example, in the DE-OS No. 3,327,453. The gerotor pump 21 has a pump chamber 52 which is limited by the inner contour of the outer rotor 50 and by the outer contour of the inner rotor 20. The pump chamber 52 at its side facing toward the drive motor 16 as considered in the axial direction is covered by the intermediate wall 28 and particularly by its end surface which faces toward the gerotor pump 21. The sealing of the pump chamber 52 of the gerotor pump 21 to the side channel pump 23 is performed by a hub region of the rotor 22 of the lateral channel pump 23. For this purpose both the inner rotor 20 of the gerotor pump 21 and the rotor 22 of the side channel pump 23 are fitted on the armature shaft 18 of the drive motor 16 near one another and connected for joint rotation with the same. The inner diameter of the hub is selected so that the inner contour of the outer rotor 50 of the gerotor pump 21 is fully covered by the hub region of the rotor 22 and particularly by its end side which faces the gerotor pump. Thereby an intermediate wall between both pump steps 21 and 23 is not needed.

Figure 5:
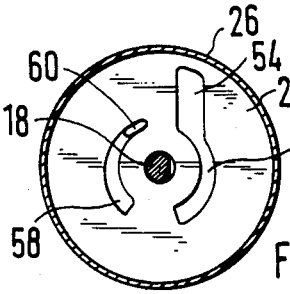
FIG. 5 is a view showing a section of the arrangement for feeding fuel in FIG. 3, taken along the line V—V.

The overflow passage 48 in the guide ring 40 merges into a connecting passage 54 which is located in the intermediate wall 28 as shown in FIG. 5. The connecting passage 54 opens into a suction groove 56 which is also arranged in the intermediate wall 28 and particularly in its end surface which faces toward the rotor pump stage 21. This end surface further has a pressure groove 58 which belongs to the gerotor pump and transits into a pressure opening 60 which opens to the chamber 32.

During the operation of the arrangement for feeding a fuel, the fuel is aspirated via the suction opening 39 to the first pump stage 23 when it is transported to the lateral channels 42 and 44 in the direction of the arrow 46 with pressure increase. Vapor bubbles which are generated by cavitation escape through a ventillation opening 62 in the cover 36 from the suction region of the pump. The thus degassed fuel flows through the overflow opening 48 in the guide ring 40 and the connecting passage 54 in the intermediate wall 28 to the suction region of the gerotor pump 21. With further pressure increase in the pump chamber 52, the fuel flows via the pressure groove 58 to the pressure opening 60 wherein it enters the chamber 32 of the arrangement 14. The chamber 32 is connected with a pressure pipe 62 arranged in the housing. The suction conduit 12 is connected with the suction pipe 38, and the pressure conduit 62 is connected with the pressure conduit 16 as can be seen from FIG. 1.

The embodiment shown in FIG. 6 substantially corresponds to the embodiment described hereinabove. The parts which are similar to the parts of the first embodiment are identified with the same reference numerals as in the FIGS. 2–5.

In contrast to the first embodiment, the design of the rotor 122 of a lateral channel pump 123 is different. In the embodiment of FIG. 6 feed members 138 are arranged not on the periphery of the rotor, but instead on its end surface which faces toward a collar 136. Therefore a so-called closed lateral channel pump is formed, as described for example in the U.S. Pat. No. 3,324,799. In this embodiment it is advantageous that an overflow passage 148 is formed as an edge open groove on the periphery of a guide ring 140, in contrast to the embodiment shown in FIGS. 2–5 in which the overflow passage 48 is formed by a perforation. Furthermore, the cross-section of a lateral passage 142 is determined in correspondence with the shape of the feed member 138 or the intermediate spaces between the neighboring fit members so that it has at least a substantially circular cross-section. The advantage of the embodiment shown in FIG. 6 is that the pressure which is formed in the side channel 142 applies an axial pressure upon the rotor 122, whereby the axial play between the rotor 122 of the flow pump 123 and the inner rotor 20 of the gerotor pump 21 is minimized and the pump efficiency is improved.

In both embodiments the rotor 22 and 122 of the flow pump 23 and the inner runner 20 of the gerotor pump 21 are arranged in direction of the axis of rotation near one another, and a wall (namely the end surface of the rotors 22 or 122 of the flow pumps 23 or 123 which faces towards the gerotor pump 121) limits at one side in an axial direction the feed chamber 52 which is surrounded by the outer runner 50 of the gerotor pump 21.

Figure 6:
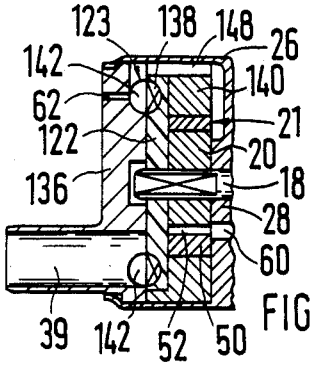
FIG. 6 is a view showing a longitudinal section through a pump region of the arrangement for feeding fuel in accordance with another embodiment of the present invention.

For better understanding of FIGS. 2 and 6 it should be mentioned that the cutting plane is offset in the rotary axis region so that the suction region with the suction opening 39 and the pressure opening 60 are visible.

It will be understood that each of the elements described above, or two or more together, may also find a useful application in other types of constructions differing from the types described above.

While the invention has been illustrated and described as embodied in an arrangement for feeding a fuel from a supply tank to an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for feeding a fuel from a supply tank to an internal combustion engine, the arrangement comprising a motor; a multistage feed pump unit driven by said motor and including a flow pump having a rotor and a gerotor pump having an inner runner arranged so that said rotor and said inner runner have aligning axes of rotation and said flow pump is arranged upstream of said gerotor pump as considered in the flow direction of a fuel, said rotor of said flow pump and said inner runner of said gerotor pump being located near one another as considered in an axial direction, said gerotor pump also having an outer runner which surrounds a feed chamber, and said rotor of said flow pump having a wall which axially limits said feed chamber surrounded by said outer runner of said gerotor pump.

2. An arrangement as defined in claim 1, wherein said rotor of said flow pump has a hub part with an end surface, said wall being formed by said end surface of said hub part of said rotor.

3. An arrangement as defined in claim 1, wherein said flow pump has a pressure region, said gerotor pump having a suction region; and further comprising means forming an overflow passage from said pressure region of said flow pump to said suction region of said gerotor pump.

4. An arrangement as defined in claim 3; and further comprising a stationary element, said overflow passage being formed at least partially in said stationary element, said outer runner of aid gerotor pump surrounded by said stationary element.

5. An arrangement as defined in claim 4, wherein said element has an end surface facing towards said rotor of said flow pump and is provided at said surface with a substantially ring-shaped channel, said rotor of said flow pump having a hub part and a plurality of feed members extending outwardly from said hub part and rotatable over a circle, said substantially ring-shaped channel being located in the region of said circle of said feed members.

6. An arrangement as defined in claim 4, wherein said rotor of said flow pump has a side which faces away of said element; and further comprising a cover arranged at said side of said rotor and having a side wall which faces toward said rotor and is provided with a channel, said element having a mirror-symmetrical channel located opposite to said channel of said cover.

7. An arrangement as defined in claim 6; and further comprising a housing, said cover being associated with said housing, said housing being provided with a suction opening, and said channel of said cover extending through said suction opening.

8. An arrangement as defined in claim 1; and further comprising a housing, and an intermediate wall fixedly connected with the housing and located between said gerotor pump and said motor, said motor having a driven shaft which is supported in said intermediate wall and having an end portion which is fixedly connected with said inner runner of said gerotor pump and with said rotor of said flow pump for joint rotation therewith.

9. An arrangement as defined in claim 8; and further comprising a stationary element having an overflow passage, said gerotor pump having a suction region, said intermediate wall having an end surface which faces towards said gerotor pump and is provided with a connecting passage, said connecting passage leading from said overflow passage of said stationary element to said suction region of said gerotor pump.

10. An arrangement as defined in claim 9, wherein said end surface of said intermediate wall which has said connecting passage has an open suction groove associated with said connecting passage.

11. An arrangement as defined in claim 10, wherein said end surface of said intermediate wall which has said connecting passage has a pressure groove of said gerotor pump; and further comprising means forming a chamber which accommodates at least a part of said motor and means forming a pressure opening, said pressure groove being connected via said pressure opening with said chamber accommodating said motor.

12. An arrangement as defined in claim 1, wherein said rotor of said flow pump has an end surface facing away of said gerotor pump and provided with feed members.

* * * * *